US006619261B1

(12) United States Patent
Wang et al.

(10) Patent No.: US 6,619,261 B1
(45) Date of Patent: Sep. 16, 2003

(54) SYSTEM FOR CONTROLLING AN OPERATING CONDITION OF AN INTERNAL COMBUSTION ENGINE

(75) Inventors: Yue Yun Wang, Columbus, IN (US); David A. Vittorio, Columbus, IN (US); John F. Wright, Columbus, IN (US)

(73) Assignee: Cummins, Inc., Columbus, IN (US)

( * ) Notice: Subject to any disclaimer, the term of this patent is extended or adjusted under 35 U.S.C. 154(b) by 0 days.

(21) Appl. No.: 10/103,427

(22) Filed: Mar. 21, 2002

(51) Int. Cl.[7] ..... F02M 7/00; F02D 41/00; F02D 23/00

(52) U.S. Cl. ..... 123/435; 123/676; 60/602; 60/603

(58) Field of Search ..... 60/602, 601, 600, 60/603, 599; 723/435, 676

(56) References Cited

U.S. PATENT DOCUMENTS

| | | | | |
|---|---|---|---|---|
| 4,466,408 A | * | 8/1984 | Cheklich | 123/435 |
| 4,616,480 A | | 10/1986 | Deutschmann et al. | |
| 4,736,724 A | * | 4/1988 | Hamburg et al. | 123/435 |
| 5,142,868 A | | 9/1992 | Woon et al. | |
| 5,359,975 A | * | 11/1994 | Katashiba et al. | 123/435 |
| 5,479,350 A | | 12/1995 | Barakchi et al. | |
| 5,526,266 A | | 6/1996 | Rutan et al. | |
| 5,566,091 A | | 10/1996 | Schricker et al. | |
| 5,842,459 A | * | 12/1998 | Akagi et al. | 123/676 |
| 5,913,301 A | | 6/1999 | Kienle et al. | |
| 5,916,130 A | | 6/1999 | Nakae et al. | |
| 6,067,498 A | | 5/2000 | Akiyama | |
| 6,092,016 A | * | 7/2000 | Sarangapani et al. | 123/676 |
| 6,155,050 A | | 12/2000 | Blanz et al. | 60/603 |
| 6,209,390 B1 | | 4/2001 | LaRue et al. | |
| 6,250,145 B1 | | 6/2001 | Honold et al. | |
| 6,256,992 B1 | | 7/2001 | Lewis, Jr. et al. | 60/603 |
| 6,338,250 B1 | | 1/2002 | Mackay | |
| 6,354,268 B1 | * | 3/2002 | Beck et al. | 123/435 |
| 6,397,820 B1 | * | 6/2002 | Novak et al. | 123/676 |
| 6,401,457 B1 | * | 6/2002 | Wang et al. | 60/602 |
| 6,497,227 B2 | * | 12/2002 | Wang et al. | 60/602 |
| 6,516,781 B2 | * | 2/2003 | Weisman | 123/435 |

FOREIGN PATENT DOCUMENTS

| | | | | |
|---|---|---|---|---|
| FR | 2545540 A1 | * | 11/1984 | 123/435 |
| JP | 57076234 A | * | 5/1982 | 123/676 |
| JP | 60104735 A | * | 6/1985 | 123/676 |

* cited by examiner

*Primary Examiner*—Thomas Denion
*Assistant Examiner*—Thai-Ba Trieu
(74) *Attorney, Agent, or Firm*—Barnes & Thornburg

(57) ABSTRACT

A system for controlling an operating condition of an internal combustion engine includes a control mechanism responsive to a final control command to establish an engine control parameter, and a control computer configured to estimate a current value of the operating condition as a function of the final control command. The control computer determines an error value as a difference between an operating condition limit and the current value of the operating condition, and determines an operating condition parameter as function of the error value and of the current value of the operating condition. The control computer further determines a control command limit as a function of the operating condition parameter, and determines the final control command as a function of the control command limit and a default control command to thereby limit the operating condition to the operating condition limit.

26 Claims, 4 Drawing Sheets

SYSTEM FOR CONTROLLING AN OPERATING CONDITION OF AN INTERNAL COMBUSTION ENGINE

FIELD OF THE INVENTION

The present invention relates generally to systems for controlling an operating condition of an internal combustion engine, and more specifically to systems for controlling an engine control mechanism in a manner that limits the engine operating condition to within a desired operating range.

BACKGROUND AND SUMMARY OF THE INVENTION

When combustion occurs in an environment with excess oxygen, peak combustion temperatures increase which leads to the formation of unwanted emissions, such as oxides of nitrogen ($NO_x$). This problem is aggravated through the use of turbocharger machinery operable to increase the mass of fresh air flow, and hence increase the concentrations of oxygen and nitrogen present in the combustion chamber when temperatures are high during or after the combustion event.

One known technique for reducing unwanted emissions such as $NO_x$ involves introducing chemically inert gases into the fresh air flow stream for subsequent combustion. By thusly reducing the oxygen concentration of the resulting charge to be combusted, the fuel burns slower and peak combustion temperatures are accordingly reduced, thereby lowering the production of $NO_x$. In an internal combustion engine environment, such chemically inert gases are readily abundant in the form of exhaust gases, and one known method for achieving the foregoing result is through the use of a so-called Exhaust Gas Recirculation (EGR) system operable to controllably introduce (i.e., recirculate) exhaust gas from the exhaust manifold into the fresh air stream flowing to the intake manifold valve, for controllably introducing exhaust gas to the intake manifold. Through the use of an on-board microprocessor, control of the EGR valve is typically accomplished as a function of information supplied by a number of engine operational sensors.

While EGR systems of the foregoing type are generally-.effective in reducing unwanted emissions resulting from the combustion process, a penalty is paid thereby in the form of a resulting loss in engine efficiency. A tradeoff thus exists in typical engine control strategies between the level of $NO_x$ production and engine operating efficiency, and difficulties associated with managing this tradeoff have been greatly exacerbated by the increasingly stringent requirements of government-mandated emission standards.

In order to achieve the dual, yet diametrically opposed, goals of limiting the production of $NO_x$ emissions to acceptably low levels while also maximizing engine operational efficiency under a variety of load conditions, substantial effort must be devoted to determining with a high degree of accuracy the correct proportions of air, fuel and exhaust gas making up the combustion charge. To this end, accurate, real-time values of a number of EGR system-related operating parameters must therefore be obtained, preferably at low cost. Control strategies must then be developed to make use of such information in accurately controlling the engine, EGR system and/or turbocharger. The present invention is accordingly directed to techniques for controlling engine operation to maintain one or more engine operating conditions within desired operating limits.

The present invention provides a system for controlling engine fueling in a manner that limits turbocharger turbine temperature to an established turbocharger turbine temperature limit.

The present invention also provides a system for controlling engine fueling in a manner that limits engine exhaust temperature to an established engine exhaust temperature limit.

The present invention further provides a system for controlling engine fueling in a manner that limits peak cylinder pressure to an established peak cylinder pressure limit.

The present invention further provides a system for controlling one or more turbocharger air handling mechanisms in a manner that limits turbocharger rotational speed to an established turbocharger speed limit.

These and other objects of the present invention will become more apparent from the following description of the preferred embodiment.

DESCRIPTION OF THE PREFERRED EMBODIMENTS

Figure 1:
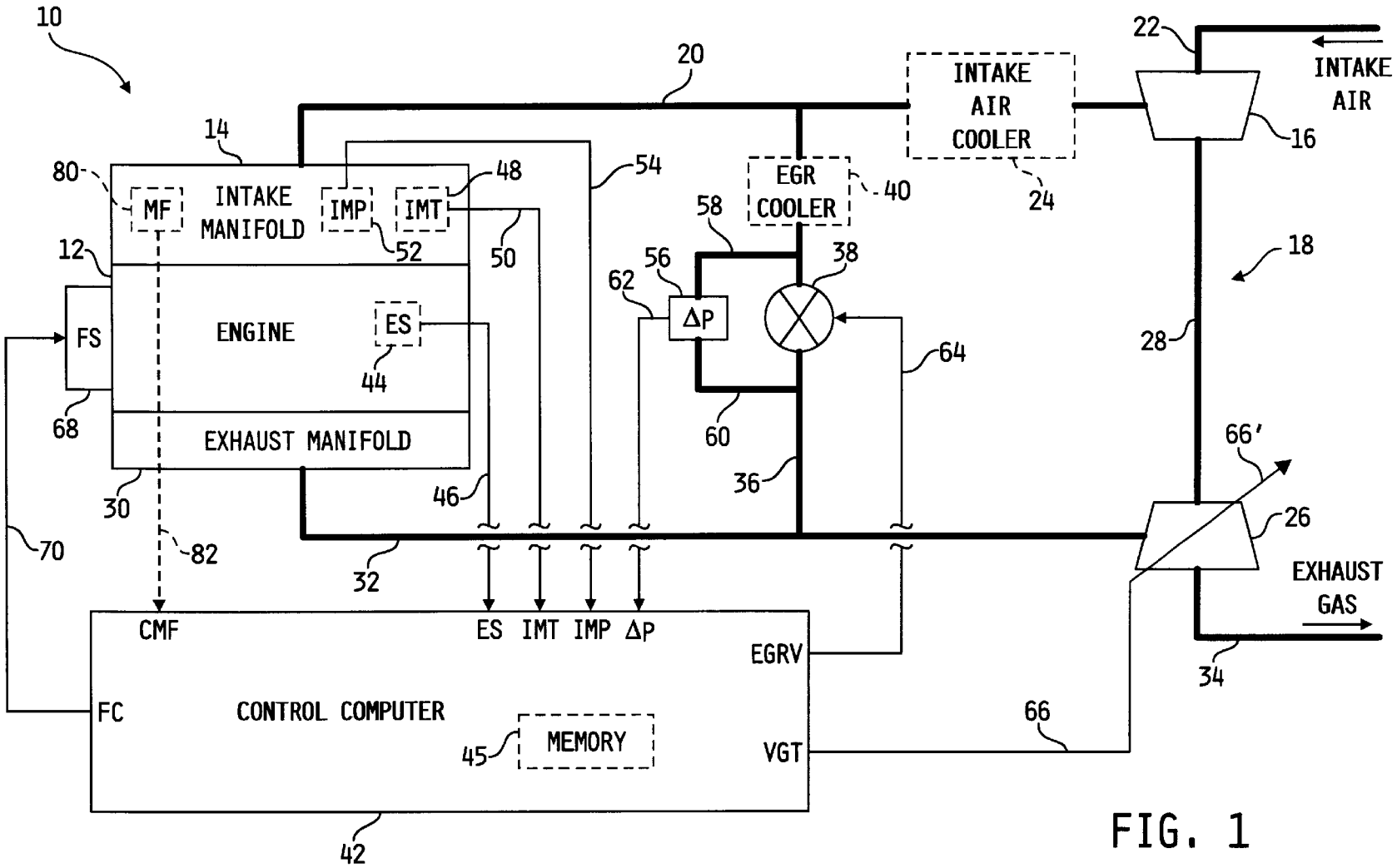
FIG. 1 is a diagrammatic illustration of one preferred embodiment of a system for controlling an operating condition of an internal combustion engine, in accordance with the present invention.

For the purposes of promoting an understanding of the principles of the invention, reference will now be made to a number of preferred embodiments illustrated in the drawings and specific language will be used to describe the same. It will nevertheless be understood that no limitation of the scope of the invention is thereby intended, such alterations and further modifications in the illustrated embodiments, and such further applications of the principles of the invention as illustrated therein being contemplated as would normally occur to one skilled in the art to which the invention relates.

Referring now to FIG. 1, a diagrammatic illustration of one preferred embodiment of a system 10 for controlling an operating condition of an internal combustion engine, in accordance with the present invention, is shown. System 10 includes an internal combustion engine 12 having an intake manifold 14 fluidly coupled to an outlet of a compressor 16 of a turbocharger 18 via an intake conduit 20, wherein the compressor 16 includes a compressor inlet coupled to an intake conduit 22 for receiving fresh air therefrom. Optionally, as shown in phantom in FIG. 1, system 10 may include an intake air cooler 24 of known construction disposed in line with intake conduit 20 between the turbocharger compressor 16 and the intake manifold 14. The turbocharger compressor 16 is mechanically coupled to a turbocharger turbine 26 via a drive shaft 28, wherein turbine 26 includes a turbine inlet fluidly coupled to an exhaust manifold 30 of engine 12 via an exhaust conduit 32, and further includes a turbine outlet fluidly coupled to ambient via an exhaust conduit 34. An EGR valve 38 is disposed in-line with an EGR conduit 36 fluidly coupled at one end to the intake conduit 20 and an opposite end to the exhaust conduit 32, and an EGR cooler 40 of known construction may optionally be disposed in-line with EGR conduit 36 between EGR valve 38 and intake conduit 20 as shown in phantom in FIG. 1.

System 10 includes a control computer 42 that is preferably microprocessor-based and is generally operable to control and manage the overall operation of engine 12. Control computer 42 includes a memory unit 45 as well as a number of inputs and outputs for interfacing with various sensors and systems coupled to engine 12. Control computer 42, in one embodiment, may be a known control unit sometimes referred to as an electronic or engine control module (ECM), electronic or engine control unit (ECU) or the like, or may alternatively be a control circuit capable of operation as will be described hereinafter. In any case, control computer 42 preferably includes one or more control algorithms, as will be described in greater detail hereinafter, for controlling an operating condition of engine 12.

Control computer 42 includes a number of inputs for receiving signals from various sensors or sensing systems associated with system 10. For example, system 10 includes an engine speed sensor 44 electrically connected to an engine speed input, ES, of control computer 42 via signal path 46. Engine speed sensor 44 is operable to sense rotational speed of the engine 12 and produce an engine speed signal on signal path 46 indicative of engine rotational speed. In one embodiment, sensor 44 is a Hall effect sensor operable to determine engine speed by sensing passage thereby of a number of equi-angularly spaced teeth formed on a gear or tone wheel. Alternatively, engine speed sensor 44 may be any other known sensor operable as just described including, but not limited to, a variable reluctance sensor or the like.

System 10 further includes an intake manifold temperature sensor 48 disposed in fluid communication with the intake manifold 14 of engine 12, and electrically connected to an intake manifold temperature input (IMT) control computer 42 via signal path 50. Intake manifold temperature sensor 48 may be of known construction, and is operable to produce a temperature signal on signal path 50 indicative of the temperature of air charge flowing into the intake manifold 14, wherein the air charge flowing into the intake manifold 14 is generally made up of fresh air supplied by the turbocharger compressor 16 combined with recirculated exhaust gas supplied by EGR valve 38.

System 10 further includes an intake manifold pressure sensor 52 disposed in fluid communication with intake manifold 14 and electrically connected to an intake manifold pressure input (IMP) of control computer 42 via signal path 54. Alternatively, pressure sensor 52 may be disposed in fluid communication with intake conduit 20. In any case, pressure sensor 52 may be of known construction, and is operable to produce a pressure signal on signal path 54 indicative of air pressure within intake conduit 20 and intake manifold 14.

System 10 further includes a differential pressure sensor, or ΔP sensor, 56 fluidly coupled at one end to EGR conduit 36 adjacent to an exhaust gas inlet of EGR valve 38 via conduit 60, and fluidly coupled at its opposite end to EGR conduit 36 adjacent to an exhaust gas outlet of EGR valve 38 via conduit 58. Alternatively, the ΔP sensor 56 may be coupled across another flow restriction mechanism disposed in-line with EGR conduit 36. In either case, the ΔP sensor 56 may be of known construction and is electrically connected to a ΔP input of control computer 42 via signal path 62. The ΔP sensor 62 is operable to provide a differential pressure signal on signal path 62 indicative of the pressure differential across EGR valve 38 or other flow restriction mechanism disposed in-line with EGR conduit 36.

Control computer 42 also includes a number of outputs for controlling one or more engine functions associated with system 10. For example, EGR valve 38 is electrically connected to an EGR valve output (EGRV) of control computer 42 via signal path 64. Control computer 42 is operable, as is known in the art, to produce an EGR valve control signal on signal path 64 to thereby control the position of EGR valve 38 relative to a reference position in a known manner. Control computer 42 is accordingly operable to control EGR valve 38 to selectively provide a flow of recirculated exhaust gas from exhaust manifold 30 to intake manifold 14.

Control computer 42 also includes at least one output, VGT, for controlling turbocharger swallowing capacity and/or efficiency, wherein the term "turbocharger swallowing capacity" is defined for purposes of the present invention as the exhaust gas flow capacity of the turbocharger turbine 2G, and the term "turbocharger swallowing efficiency" refers to response of the turbocharger turbine 26 to the flow of engine exhaust gas. In general, the swallowing capacity and/or efficiency of the turbocharger 18 directly affects a number of engine operating conditions including, for example, but not limited to, compressor outlet pressure and turbocharger rotational speed. One aspect of the present invention is directed to controlling the swallowing capacity and/or efficiency of the turbocharger 18 via one or more various control mechanisms under the direction of control computer 42 to thereby limit an engine operating condition to an engine operating condition limit value.

System 10 may include any one or more of a number of air handling mechanisms for controlling turbocharger swallowing capacity and/or efficiency, and any such mechanisms are illustrated generally in FIG. 1 as a variable geometry turbocharger turbine (VGT) 66' electrically connected to the VGT output of control computer 42 via signal path 66. One example turbocharger swallowing capacity control mechanism that may be included within system 10 is a known electronically controllable variable geometry turbocharger turbine 26. In this regard, turbine 26 includes a variable geometry actuator (not shown) electrically connected to signal path 66. In this embodiment, control computer 42 is operable to produce a variable geometry turbocharger control signal on signal path 66 to control the swallowing capacity (i.e., exhaust gas flow capacity) of turbine 26 by controlling the flow geometry of turbine 26 in a known manner. Another example turbocharger swallowing capacity control mechanism that may be included within system 10 is a known electronically controllable exhaust throttle (not shown) having an exhaust throttle actuator (not shown) electrically connected to signal path 66. In this embodiment, the exhaust throttle is disposed in-line with exhaust conduit 34 or exhaust conduit 32, and control computer 42 is operable to produce an exhaust throttle control signal on signal path 66 to control the position of exhaust throttle relative to a reference position. The position of the exhaust throttle defines a cross-sectional flow area therethrough, and by controlling the cross-sectional flow are of the exhaust throttle, control computer 42 is operable to control the flow rate of exhaust gas produced by engine 12, and thus the swallowing capacity (i.e., exhaust gas flow capacity) of turbine 26.

One turbocharger swallowing efficiency control mechanism that may be included within system 10 is a known electronically controllable wastegate valve (not shown) having a wastegate valve actuator (not shown) electrically connected to signal path 66. The wastegate valve has an inlet fluidly coupled to exhaust conduit 32, and an outlet fluidly coupled to exhaust conduit 34, and control computer 42 is operable to produce a wastegate valve control signal on signal path 66 to control the position of the wastegate valve relative to a reference position. The position of the wastegate valve defines a cross-sectional flow area therethrough, and by controlling the cross-sectional flow area of the wastegate valve, control computer 42 is operable to selectively divert exhaust gas away from turbine 26, and thereby control the swallowing efficiency of turbine 26.

It is to be understood that while FIG. 1 is illustrated as including only a general turbocharger swallowing capacity/efficiency control mechanism 66', the present invention contemplates embodiments of system 10 that include any single one, or any combination, of the foregoing example turbocharger air handling control mechanisms. Additionally, control computer 42 may be configured in a known manner to control any one or combination of such example turbocharger air handling control mechanisms to thereby control turbocharger swallowing capacity and/or efficiency.

System 10 further includes a fuel system 68 electrically connected to a fuel command output (FC) of control computer 42 via signal path 70. Fuel system 68 is responsive to fueling commands produced by control computer 42 on signal path 70 to supply fuel to engine 12. In accordance with one aspect of the present invention, control computer 42 is operable, as will be described in greater detail hereinafter, to produce such fueling commands in a manner that maintains an engine operating condition within one or more specified limits.

Figure 2:
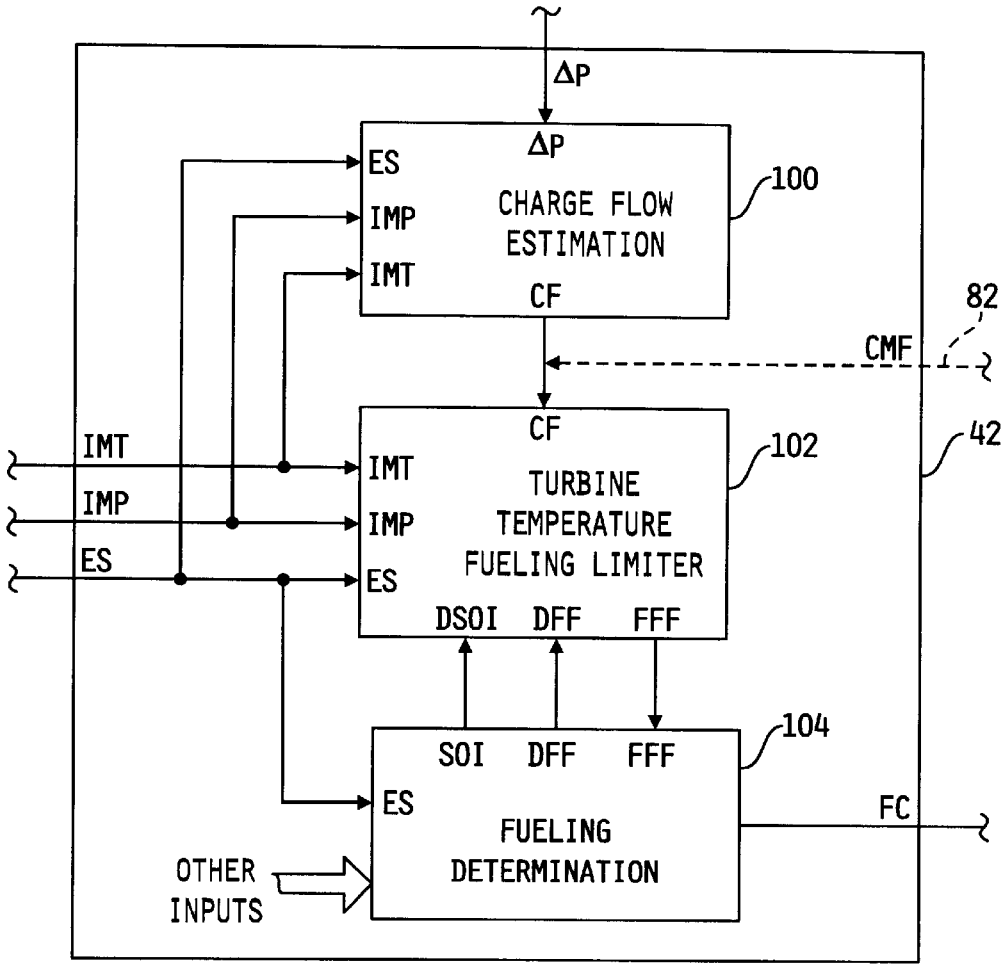
FIG. 2 is a block diagram illustration of one preferred embodiment of a portion of the control computer of FIG. 1 specifically configured to control turbocharger turbine temperature, in accordance with the present invention.

Referring now to FIG. 2, a block diagram is shown illustrating one preferred embodiment of a portion of the control computer 42 of FIG. 1, specifically configured to control turbocharger turbine temperature, in accordance with the present invention. Control computer 42 includes a fueling determination block 104 receiving the engine speed signal (ES) from engine speed sensor 44 via signal path 46, as well as a number of additional input signals. Block 104 is responsive to the ES signal on signal path 46 as well as one or more of the additional signals to compute a fueling command (FC) as a function of a mass fuel flow rate (fuel flow) value and of a start-of-fuel injection timing value in accordance with techniques well-known in the art. In conventional systems, the fueling determination block is operable to compute the start-of-injection (SOI) value and a default fuel flow value (DFF), and to generate the fueling commands as a function of SOI and DFF. In accordance with the present invention, however, the fueling determination block 104 is operable to supply SOI and DFF to a turbine temperature fueling limiter block 102, and block 102 is operable to provide a final fuel flow value (FFF) back to the fueling determination block 104 in a manner that will be described in greater detail hereinafter. The fueling determination block 104, in the system 10 of the present invention, is then operable to produce fueling commands on signal path 70 as a function of the start-of-injection value, SOI, and of the final fuel flow value (fuel mass flow rate), FFF in a manner that limits the operating temperature of the turbocharger turbine 26 to a maximum operating temperature.

In accordance with the present invention, control computer 42 further includes a turbine temperature fueling limiter block 102 receiving the engine speed signal, ES, from engine speed sensor 44 via signal path 46, the intake manifold temperature signal, IMT, from the intake manifold temperature sensor 48 via signal path 50, the intake manifold pressure signal, IMP, from intake manifold pressure sensor 52 via signal path 54, and the default fuel flow value, DFF, and the start-of-injection value, SOI, from the fueling determination block 104. The turbine temperature fueling limiter block 102 also receives a charge flow value, CF, corresponding to a mass flow of air charge (combination of fresh air supplied by compressor 16 and recirculated exhaust gas provided by EGR valve 38) into the intake manifold 14. Block 102 is operable, as will be described in detail hereinafter, to process the foregoing information and provide a final fuel flow value, FFF, to the fueling determination block 104. Block 104 is, in turn, operable to produce fueling commands on signal path 70 as a function of the start-of-injection value, SOI, and the final fuel flow value, FFF, that limit the turbine operating temperature to a predefined maximum temperature.

In one embodiment, the charge flow value, CF, provided to the turbine temperature fueling limiter block 102 is an estimated charge flow value produced by a charge flow estimation block 100. Block 100 receives as inputs the engine speed signal,ES, on signal path 46, the intake manifold pressure signal, IMP, on signal path 54, the intake manifold temperature value, IMT, on signal path 50 and the differential pressure signal, ΔP, on signal path 62, and produces the charge flow value, CF, corresponding to the mass flow rate of charge entering the intake manifold 14, as a function of the various input signals to block 100.

In one preferred embodiment, the charge flow estimation block 100 is operable to compute an estimate of the charge flow value, CF, by first estimating the volumetric efficiency ($\eta_V$) of the charge intake system, and then computing CF as a function of $\eta_V$ using a conventional speed/density equation. Any known technique for estimating $\eta_V$ may be used, and in one preferred embodiment of block 100 $\eta_V$ is computed according to a known Taylor mach number-based volumetric efficiency equation given as:

$$\eta_V = A_1 * \{(\text{Bore}/D)^2 * (\text{stroke} * ES)^B / \text{sqrt}\ (\gamma * R * IMT) * [(1 + EP/IMP) + A_2]\} + A_3 \quad (1),$$

where, $A_1$, $A_2$, $A_3$ and B are all calibratable parameters preferably fit to the volumetric efficiency equation based on mapped engine data, Bore is the intake valve bore length, D is the intake valve diameter, stroke is the piston stroke length, wherein Bore, D and stroke are generally dependent upon engine geometry, γ and R are known constants (e.g., γ*R=387.414 KJ/kg/deg K), ES is engine speed, IMP is the intake manifold pressure, EP is the exhaust pressure, where EP=IMP+ΔP, and IMT=intake manifold temperature.

With the volumetric efficiency value $\eta_V$ estimated according to the foregoing equation, the estimate charge flow value, CF, is preferably computed according to the equation:

$$CF = \eta_V * V_{DIS} * ESP * IMP / (2 * R * IMT) \quad (2),$$

where, $\eta_V$ is the estimated volumetric efficiency, $V_{DIS}$ is engine displacement and is generally dependent upon engine geometry, ES is engine speed, IMP is the intake manifold pressure, R is a known gas constant (e.g., R=54), and IMT is the intake manifold temperature.

In an alternate embodiment, the charge flow value, CF, may be obtained directly from a mass flow sensor 80 disposed in fluid communication with intake manifold 14 or with intake conduit 20 downstream of the junction with EGR conduit 36, and electrically connected to a charge mass flow input (CMF) of control computer 42 via signal path 82, as shown in phantom in FIGS. 1 and 2.

Figure 3:
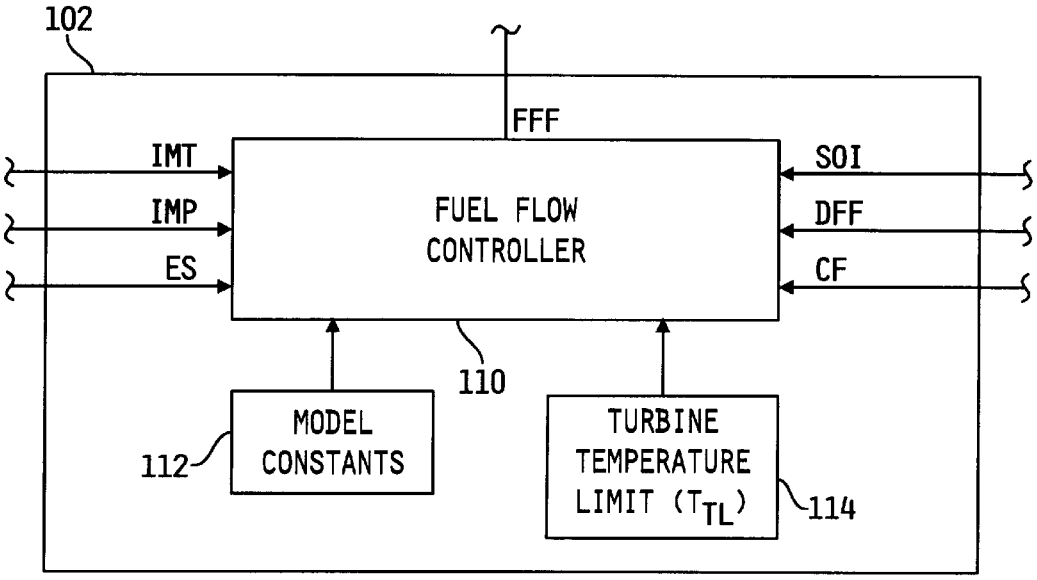
FIG. 3 is a block diagram illustration of one preferred embodiment of the turbine temperature fueling limiter block of FIG. 3, in accordance with the present invention.

Referring now to FIG. 3, one preferred embodiment of the turbine temperature fueling limiter block 102, in accordance with the present invention, is shown. In the embodiment of block 102 illustrated in FIG. 3, a fuel flow controller block 110 receives input signals ES and IMT and optionally IMP from associated sensors described with respect to FIG. 1. Block 110 also receives the mass charge flow value CF either from the estimation algorithm described with respect to the charge flow estimation block 100 or from a mass air flow sensor 80 as described with respect to FIGS. 1 and 2, and further receives either the default fuel flow value, DFF, corresponding to a fuel mass flow rate, and the start-of-injection value, SOI, from the fueling determination block 104.

Block 102 further includes a model constants block 112 having various model constants stored therein, wherein block 112 is operable to provide such constants to block 102. Block 102 further includes a turbine temperature limit block 114 producing a turbine temperature limit value ($T_{TL}$). Block 114 is operable to supply $T_{TL}$ to the fuel flow controller block 110. $T_{TL}$ may be a programmable static value stored within block 114, or may instead be a dynamic value determined as a function of one or more other engine operating parameters, and in any case represents a maximum allowable turbine temperature limit.

In accordance with the present invention, the fuel flow controller block 110 is responsive to the various input signals and values to compute a final fuel flow value, FFF, corresponding to a mass flow rate of fuel, and to supply this value to the fueling determination block 104 of FIG. 2. The fueling determination block 104 is, in turn, operable to determine a fueling command as a function of the start-of-injection value, SOI, and of the final fuel flow value, FFF, provided by the fuel flow controller block 110, and to provide the fueling command on signal path 70. The fueling command resulting from the function of SOI and FFF limits engine fueling so as to limit the maximum temperature of the turbocharger turbine 26 to the turbine temperature limit value, $T_{TL}$.

Figure 4:
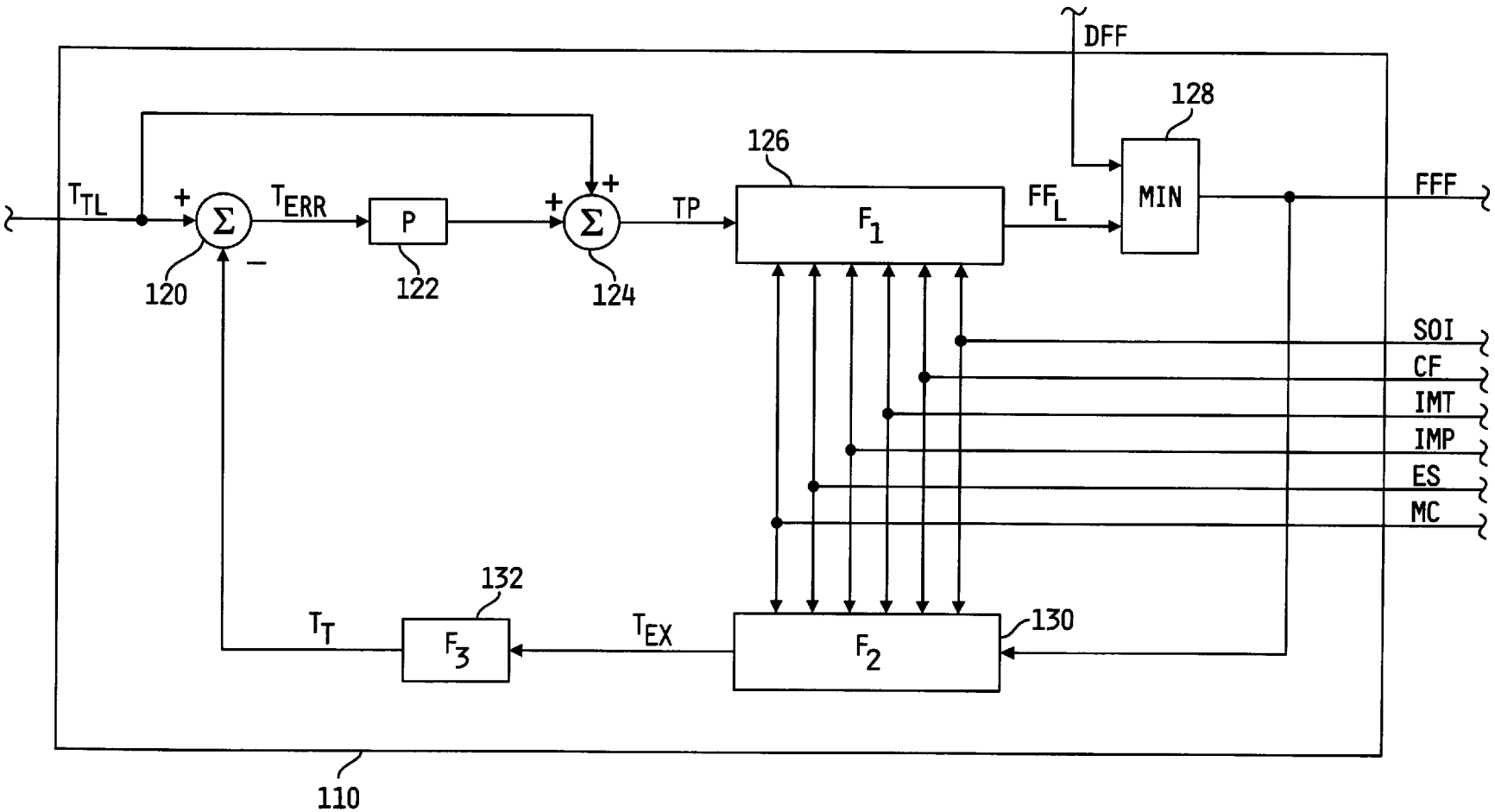
FIG. 4 is a block diagram illustration of one preferred embodiment of the fuel flow controller block of FIG. 3, in accordance with the present invention.

Referring now to FIG. 4, a block diagram illustration of one preferred embodiment of the fuel flow controller block 110 of FIG. 3, in accordance with the present invention, is shown. Block 110 includes a first summation node 120 having a non-inverting input receiving the turbine temperature limit value, $T_{TL}$, and an inverting input receiving an estimated turbine temperature value, $T_T$, from a feedback block 132. An output of summation node 120 produces a temperature error value $T_{ERR}$ corresponding to the difference between the commanded turbine temperature limit value, $T_{TL}$, and the estimated turbine temperature value, $T_{TL}$. The temperature error value, $T_{ERR}$, is provided as an input to a gain block 122 having a predefined gain value, P. The output of gain block 122 is provided to a first non-inverting input of a second summation node 124, and a second non-inverting input of node 124 receives the commanded turbine temperature limit value, $T_{TL}$. The output of summation node 124 produces a temperature parameter, TP, according to the relationship:

$$TP=T_{TL}+P^*(T_{TL}-T_T) \quad (3).$$

The temperature parameter, TP, is provided as one input to a first function block 126. Function block 126 also receives as inputs the ES, IMT and IMP signals produced by corresponding sensors, the SOI value produced by the fueling determination block 104 (FIG. 2), the charge flow value, CF, produced by either the charge flow estimation block 100 (FIG. 2) or the mass flow sensor 80, and the model constants produced by the model constants block 112 (FIG. 3). Function block 126 includes a model-based function, F1 that produces a fuel flow limit, $FF_L$, as a function of the various inputs to block 126. The fuel flow limit, $FF_L$, corresponds to the fuel mass flow rate at which the turbine temperature will be equal to the turbine temperature limit value, $T_{TL}$. The fuel flow limit, $FF_L$, is provided as one input to a MIN block 128 having a second input receiving the default fuel flow value, DFF, produced by the fueling determination block 104 (FIG. 2). The output of the MIN block 128 is the final fuel flow value, FFF that is provided by the fuel flow controller block 110 to the fueling determination block 104 as illustrated in FIG. 2.

The final fuel flow value, FFF, is also fed back to one input of a second function block 130, wherein block 130 also receives as inputs the ES, IMT and IMP signals produced by corresponding sensors, the SOI value produced by the fueling determination block 104 (FIG. 2), the charge flow value, CF, produced by either the charge flow estimation block 100 (FIG. 2) or the mass flow sensor 80, and the model constants produced by the model constants block 112 (FIG. 3). Function block 130 includes a model-based function, F2 that produces an estimate of the engine exhaust gas temperature, $T_{EX}$, as a function of the various inputs to block 130. The exhaust gas temperature estimate, $T_{EX}$, is provided to function block 132 operable to estimate the temperature of the turbocharger turbine, $T_T$, as a function of the exhaust gas temperature estimate, $T_{EX}$. The turbocharger turbine temperature output, $T_T$, of block 132 is provided to the inverting input of summation node 120 to complete the feedback loop.

Block 130 of the fuel flow controller block 110 defines a function, F2, for estimating engine exhaust temperature as a function of the various inputs thereto. In one embodiment, F2 is of the form:

$$T_{EX}=IMT+(FFF/CF)\ (A^*ES+B^*IMP+C^*SOI) \quad (4),$$

where,

IMT is the intake manifold temperature,

FFF is the final fuel flow value produced by MIN block 128,

CF is the charge flow value,

ES is the engine speed,

IMP is the intake manifold pressure,

SOI is the start-of-injection value, and

A, B and C are the model constants stored within block 112 (FIG. 3).

Those skilled in the art will recognize other known strategies for estimating engine exhaust temperature, $T_{EX}$, as a function of one or more engine operating parameters, and any such other known strategies are intended to fall within the scope of the present invention. One such other known engine exhaust temperature estimation strategy is described in co-pending U.S. patent application Ser. No. 09/1774,664, a entitled SYSTEM FOR ESTIMATING ENGINE EXHAUST TEMPERATURE, which is assigned to the assignee of the present invention, and the disclosure of which is incorporated herein by reference.

Block 126 of the fuel flow controller block 110 defines a function, F1, for determining the fuel flow limit, $FF_L$, as a function of the various inputs thereto, and in one embodiment, F1 is based on equation (4) above. Solving equation (4) for FFF in terms of a fueling limit and substituting the temperature parameter TP for $T_{EX}$ yields the following equation for the function F1:

$$FF_L=CF^*(TP-IMT)/[A^*ES+B^*IMT+C^*SOI] \quad (5),$$

Where, $FF_L$ is the fueling limit provided by block 126 to MIN block 128, and TP is the temperature parameter produced at the output of summation node 124.

Block 132 of the fuel flow controller block 110 defines a function, F3, for estimating the turbocharger turbine temperature, $T_T$, from the estimated engine exhaust temperature, $T_{EX}$. In one embodiment, F3 is based on a heat transfer model of the form:

$$dT_T/dt=h(T_{EX-TT}) \quad (6),$$

such that, $$T_T(S)=T_{EX}(S)/(\tau S+1) \quad (7),$$

wherein $\tau=1/h$ and defines a time constant.

In the operation of block 110 of FIG. 4, when the turbocharger turbine temperature, $T_T$, is below the commanded turbine temperature limit, $T_{TL}$, the temperature parameter, TP, defined by equation (3) above will be greater than the commanded turbine temperature limit, $T_{TL}$. In this case, the fuel flow limit, $FF_L$, produced by block 126 will be greater than the default fuel flow value, DFF, produced by the fueling determination block 104 (FIG. 2), and the MIN block 128 will accordingly produce the default fuel flow value, DFF, as the final fuel flow value, FFF. The fueling commands on signal path 70 will thus be computed by the fueling determination block 104 in the normal manner as a function of SOI and DFF. However, when the turbocharger turbine temperature, $T_T$, reaches and attempts to exceed the commanded turbine temperature limit, $T_{TL}$, the temperature parameter, TP, defined by equation (3) above will drop slightly below the commanded turbine temperature limit, $T_{TL}$. In this case, the fuel flow limit, $FF_L$, will be less than the default fuel flow value, DFF, produced by the fueling determination block 104, and the MIN block will accordingly produce the fuel flow limit value, $FF_L$ as the final fuel flow value, FFF. The fueling commands on signal path 70 will thus be limited to a fuel flow rate than maintains the turbine temperature below the commanded turbine temperature limit, $T_{TL}$.

While the invention has been illustrated and described in detail in the foregoing drawings and description, the same is to be considered as illustrative and not restrictive in character, it being understood that only preferred embodiments thereof have been shown and described and that all changes and modifications that come within the spirit of the invention are desired to be protected. For example, function block 132 of FIG. 4 may be omitted and the turbine temperature limit value, $T_{TL}$, replaced with an engine exhaust temperature limit, $T_{EXL}$, to thereby produce a final fuel flow value, FFF, that limits engine exhaust temperature to the engine exhaust temperature limit, $T_{EXL}$.

Those skilled in the art will recognize that the feedback and feed forward control strategy illustrated and described with respect to FIG. 4 may be used to maintain other engine operating conditions within desired operating limits. In general, the system of the present invention may be used to control an operating condition of an internal combustion engine wherein the system includes a control mechanism responsive to a final control command to establish an engine control parameter, and wherein the control computer is operable to estimate a current value of the operating condition as a function of the final control command, to determine an error value as a difference between an operating condition limit and the current value of the operating condition, to determine an operating condition parameter as function of the error value and of the current value of the operating condition, to determine a control command limit as a function of the operating condition parameter, and to determine the final control command as a function of the control command limit and a default control command to thereby limit the operating condition to the operating condition limit.

Figure 5:
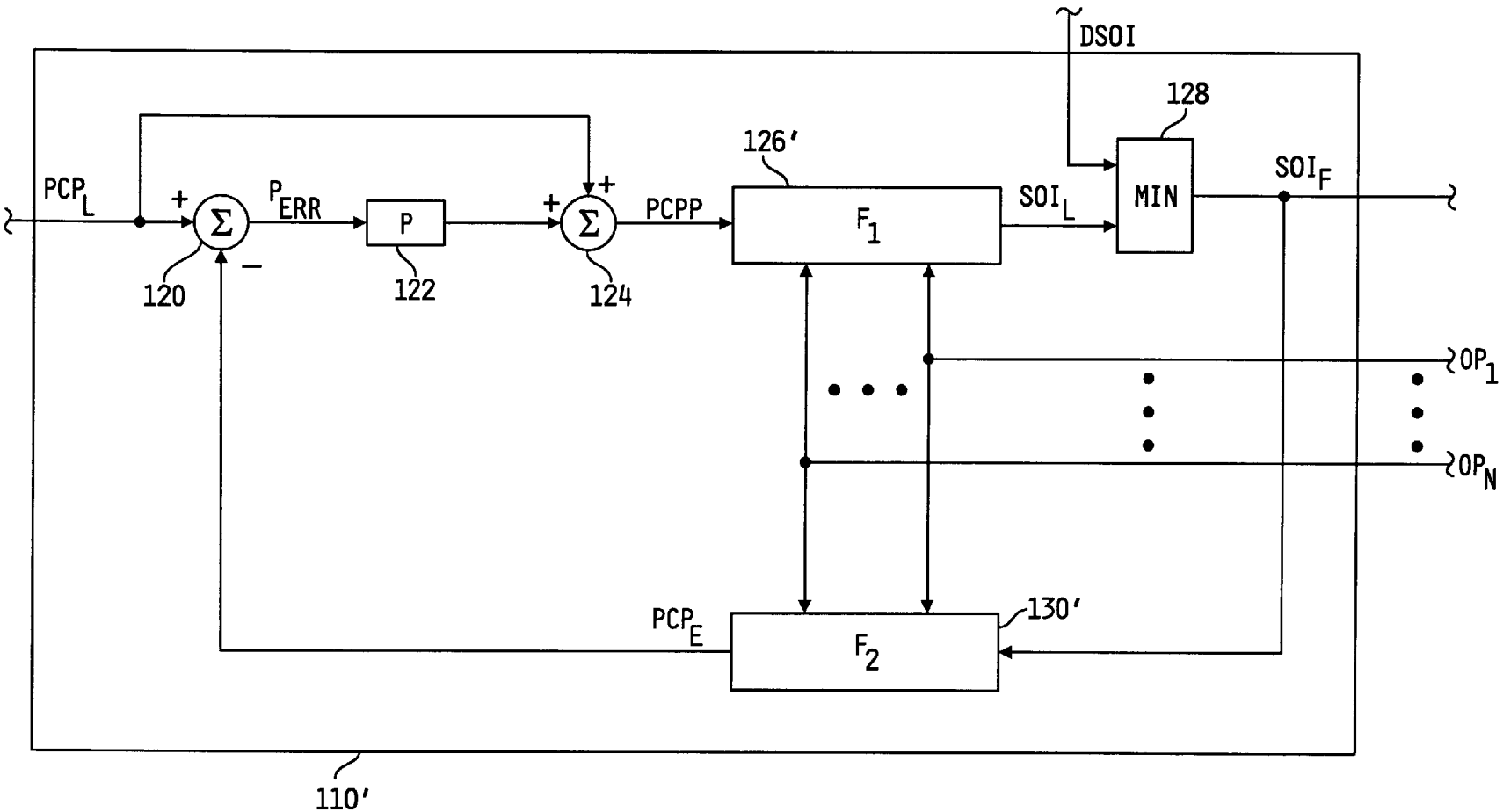
FIG. 5 is a block diagram illustration of an alternate embodiment of the controller block of FIG. 3, in accordance with the present invention, for controlling peak cylinder pressure.

As one specific example of the general applicability of the foregoing concepts, the strategy illustrated in FIGS. 1–4 may be used to limit peak cylinder pressure to a peak cylinder pressure limit via control of the fueling command on signal path 70. In this example, the engine operating condition is peak cylinder pressure, PCP, the control mechanism is the fuel system 68, the final control command is a final start-of-injection value, $SOI_F$, the engine control parameter is the fueling command produced on signal path 70, the operating condition limit is a peak cylinder pressure limit value, $PCP_L$, the operating condition parameter is a peak cylinder pressure parameter, PCPP, similar to the turbine temperature parameter, TP, described hereinabove, the control command limit is a start-of-injection limit value, $SOI_L$, and the default control command is a default start-of-injection value (SOI in FIG. 2). In this example, block 132 may be omitted, and the foregoing modifications to the control structure of FIG. 4 for controlling peak cylinder pressure are illustrated in a peak cylinder pressure limiting fueling controller embodiment 110' shown in FIG. 5. Functions blocks 126' and 130' form F1 and F2 models functionally relating peak cylinder pressure to a start-of-injection (SOI) value used in the engine fueling determination as described hereinabove. An example of one model-based system for estimating peak cylinder pressure that may be used within blocks 126' and 130' of FIG. 5 is detailed in co-pending U.S. patent application Ser. No. 10/118,419, entitled SYSTEM FOR ESTIMATING PEAK CYLINDER PRESSURE IN AN INTERNAL COMBUSTION ENGINE, having attorney docket no. 29766-69970, which is assigned to the assignee of the present invention, and the disclosure of which is incorporated herein by reference. According to this model, peak cylinder pressure is estimated as a function of intake manifold pressure, IMP, intake manifold temperature, IMT, charge fuel ratio, CFR, and start-of-injection (SOI). For this example, the control strategy of FIGS. 2–4 may be modified to determine a start-of-injection limit, $SOI_L$, as a function of a difference between the peak cylinder pressure limit value, $PCP_L$ and an estimated peak cylinder pressure value, $PCP_E$, and a final start-of-injection value, $SOI_F$, as the minimum of the default SOI and $SOI_L$. The fueling determination block 104 is then responsive to $SOI_F$ to limit fuel to engine 12 in a manner that limits peak cylinder pressure to the peak cylinder pressure limit value, $PCP_L$. Such modifications to the system of FIGS. 1–4 are well within the skill level of an artisan practicing in the art to which the present invention pertains.

As another specific example of the general applicability of the foregoing concepts, the strategy illustrated in FIGS. 1–4 may be used to limit turbocharger rotational speed to a commanded turbocharger speed limit. In embodiments of system 10 that do not include any mechanism for controlling the swallowing capacity/efficiency of the turbocharger 18, turbocharger speed, TS, may be modeled in a known manner as a function of engine speed, ES, and the fueling command, FC; i.e., TS=f(ES, FC). For this example, the control strategy of FIGS. 2–4 may be modified to determine a fueling command limit, $F_L$, as a function of a difference between the a turbocharger speed limit value, $TS_L$, and an estimated turbocharger speed value, $TS_E$, and a final fuel command value, $FC_F$, as the minimum of the default fueling command, FC, and $FC_L$. The fueling determination block 104 is then operable to limit fuel to engine 12 in a manner that limits turbocharger speed, TS, to the turbocharger speed limit value, $TS_L$. Such modifications to the system of FIGS. 1–4 are well within the skill level of an artisan practicing in the art to which the present invention pertains.

In embodiments of system 10 that do include one or more mechanisms for controlling the swallowing capacity/efficiency of the turbocharger 18, turbocharger speed, TS, may be modeled as a function of engine speed, ES, fueling command, FC, and VG position, VGP; i.e., TS=f(ES, FC, VGP), wherein VGP corresponds to the position of any one or more controllable mechanisms for controlling the swallowing capacity/efficiency of the turbocharger 18. In this example, control computer 42 may be configured to limit turbocharger rotational speed to a commanded turbocharger speed limit via control of one or more of the air handling mechanisms associated with the turbocharger 18 (e.g., variable geometry turbocharger actuator, exhaust throttle, wastegate valve, or the like). In this example, the engine operating condition is turbocharger rotational speed, the control mechanism is an air handling actuator (e.g., variable geometry turbocharger actuator, exhaust throttle actuator and/or wastegate valve actuator), the final control command is a final air handling actuator command (VGP), the engine control parameter is air handling actuator position, the operating condition limit is a turbocharger speed limit value, the operating condition parameter is a turbocharger speed parameter similar to the turbine temperature parameter, TP, described hereinabove, the control command limit is an air handling system actuator command limit and the default control command is a default air handling system actuator command. In this example, block 132 may be omitted, and functions F1 and F2 form models functionally relating turbocharger speed to one or more air handling actuator command or position values. An example of a model-based system for estimating turbocharger speed is detailed in co-pending U.S. patent application Ser. No. 10/102,233, entitled SYSTEM FOR ESTIMATING TURBOCHARGER ROTATIONAL SPEED, having attorney docket no. 29766-69256, which is assigned to the assignee of the present invention, and the disclosure of which is incorporated herein by reference. According to this model, turbocharger rotational speed is estimated as a function of compressor inlet temperature, engine speed, compressor inlet pressure and compressor outlet pressure (i.e., boost pressure). Modification of this model for use with the present invention would require expressing the compressor outlet pressure as a function of the one or more air handling system actuator command or position values, VGP, and such a modification is well within the skill level of an artisan practicing in the art to which the present invention pertains.

Those skilled in the art will recognize other applications of the concepts described herein, and such other applications are intended to fall within the scope of the present invention.

What is claimed is:

1. System for controlling an operating condition of an internal combustion engine, the system comprising:

a control mechanism responsive to a final control command to establish an engine control parameter;

means for estimating a current value of the operating condition as a function of the final control command;

means for determining an error value as a difference between an operating condition limit and the current value of the operating condition;

means for determining an operating condition parameter as function of the error value and of the current value of the operating condition;

means for determining a control command limit as a function of the operating condition parameter; and means for determining the final control command as a function of the control command limit and a default control command to thereby limit the operating condition to the operating condition limit.

2. The system of claim 1 further including a memory unit having the operating condition limit stored therein.

3. The system of claim 1 wherein the final control command is a final fuel command and the control mechanism is a fuel system responsive to the final fuel command to supply fuel to the engine.

4. The system of claim 3 wherein the operating condition is engine exhaust temperature, and the operating condition limit is an engine exhaust gas temperature limit.

5. The system of claim 3 wherein the operating condition is turbocharger turbine temperature, and the operating condition limit is a turbocharger turbine temperature limit.

6. The system of claim 3 wherein the operating condition is peak cylinder pressure, and the operating condition limit is a peak cylinder pressure limit.

7. The system of claim 5 wherein said means for estimating a current value of the operating condition as a function of the final control command includes:

means for estimating engine exhaust temperature as a function of the final fuel command; and means for determining turbocharger turbine temperature as a function of the engine exhaust temperature.

8. The system of claim 7 wherein said means for determining an operating condition parameter as function of the error value and of the current value of the operating condition includes:

a gain unit producing a modified error value as a product of said error value and a gain value; and a summation unit producing said operating condition parameter as a sum of said modified error value and the current value of the turbocharger turbine temperature.

9. The system of claim 1 further including a turbocharger having a variable geometry (VG) turbine;

and wherein the final control command is a final VG position command and the control mechanism is a VG control mechanism responsive to the final VG position command to establish a corresponding swallowing capacity of the turbine.

10. The system of claim 9 wherein the operating condition is rotational speed of the turbocharger, and the operating condition limit is a turbocharger speed limit.

11. System for controlling an operating condition of an internal combustion engine, the system comprising:

a control mechanism responsive to a final control command to establish an engine control parameter; and a control computer configured to estimate a current value of the operating condition as a function of the final control command, said control computer determining an error value as a difference between an operating condition limit and the current value of the operating condition and determining an operating condition parameter as function of the error value and of the current value of the operating condition, said control computer determining a control command limit as a function of the operating condition parameter and determining the final control command as a function of the control command limit and a default control command to thereby limit the operating condition to the operating condition limit.

12. The system of claim 11 wherein the final control command is a final fuel command and the control mechanism is a fuel system responsive to the final fuel command to supply fuel to the engine.

13. The system of claim 12 wherein the operating condition is engine exhaust temperature, and the operating condition limit is an engine exhaust gas temperature limit.

14. The system of claim 12 wherein the operating condition is turbocharger turbine temperature, and the operating condition limit is a turbocharger turbine temperature limit.

15. The system of claim 12 wherein the operating condition is peak cylinder pressure, and the operating condition limit is a peak cylinder pressure limit.

16. The system of claim 12 wherein said control computer is operable to estimate a current value of the operating condition as a function of the final control command by estimating engine exhaust temperature as a function of the final fuel command, and determining turbocharger turbine temperature as a function of the engine exhaust temperature.

17. The system of claim 16 wherein said control computer is operable to determine the operating condition parameter as function of the error value and of the current value of the operating condition by determining a modified error value as a product of said error value and a gain value, and producing said operating condition parameter as a sum of said modified error value and the current value of the turbocharger turbine temperature.

18. The system of claim 11 further including a turbocharger having a variable geometry (VG) turbine;

and wherein the final control command is a final VG position command and the control mechanism is a VG control mechanism responsive to the final VG position command to establish a corresponding swallowing capacity of the turbine.

19. The system of claim 18 wherein the operating condition is rotational speed of the turbocharger, and the operating condition limit is a turbocharger speed limit.

20. A method of controlling an operating condition of an internal combustion engine, the method comprising the steps of:

estimating a current value of the operating condition as a function of a final control mechanism command;

determining an error value as a difference between an operating condition limit and the current value of the operating condition;

determining an operating condition parameter as a function of the error value and of the operating condition limit;

determining a control mechanism limit value as a function of the operating condition parameter; and determining the final control mechanism command as a minimum of a default control mechanism command and the control mechanism limit value to thereby limit the operating condition to the operating condition limit.

21. The method of claim 20 wherein the final control mechanism command is a final fueling command for fueling the engine.

22. The method of claim 21 wherein the operating condition is engine exhaust temperature, and the operating condition limit is an engine exhaust temperature limit.

23. The method of claim 21 wherein the operating condition is turbocharger turbine temperature, and the operating condition limit is a turbocharger turbine temperature limit.

24. The method of claim 21 wherein the operating condition is peak cylinder pressure, and the operating condition limit is a peak cylinder pressure limit.

25. The method of claim 20 wherein the final control mechanism command is a variable geometry turbocharger position command for establishing a turbocharger swallowing capacity.

26. The method of claim 25 wherein the operating condition is turbocharger rotational speed, and the operating condition limit is a turbocharger speed limit.

* * * * *

UNITED STATES PATENT AND TRADEMARK OFFICE

CERTIFICATE OF CORRECTION

PATENT NO. : 6,619,261 B1
DATED : September 16, 2003
INVENTOR(S) : Wang et al.

It is certified that error appears in the above-identified patent and that said Letters Patent is hereby corrected as shown below:

Column 1,
Line 40, please delete ".effective" and insert -- effective --.

Column 4,
Line 23, please delete "2G" and insert -- 26 --.

Column 6,
Line 24, please delete "signal,ES" and insert -- signal, ES --.

Column 8,
Line 66, please delete "09/1774,664," and insert -- 09/774,664, --.

Column 9,
Line 1, please delete "a entitled" and insert -- entitled --.
Line 25, please delete "$_{TT}$" and insert -- $T_T$ --.

Signed and Sealed this

Sixteenth Day of December, 2003

JAMES E. ROGAN
*Director of the United States Patent and Trademark Office*